US010227214B1

(12) United States Patent
Sefcik

(10) Patent No.: US 10,227,214 B1
(45) Date of Patent: Mar. 12, 2019

(54) PASSENGER CONVEYOR SKIRT PANEL POSITIONING ASSEMBLY

(71) Applicant: OTIS ELEVATOR COMPANY, Farmington, CT (US)

(72) Inventor: Gregory Michael Sefcik, Cottage Grove, WI (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/919,482

(22) Filed: Mar. 13, 2018

(51) Int. Cl.

| | |
|---|---|
| ***B66B 21/02*** | (2006.01) |
| ***B66B 23/22*** | (2006.01) |
| ***B66B 31/00*** | (2006.01) |
| ***B66B 29/00*** | (2006.01) |

(52) U.S. Cl.
CPC ..... *B66B 23/22* (2013.01); *B66B 21/02* (2013.01); *B66B 29/00* (2013.01); *B66B 31/00* (2013.01)

(58) Field of Classification Search
CPC ..... B66B 21/00; B66B 21/02; B66B 21/08; B66B 23/22; B66B 23/00; B66B 23/14
USPC ..... 198/321, 324, 326
See application file for complete search history.

(56) References Cited

U.S. PATENT DOCUMENTS

| | | | | |
|---|---|---|---|---|
| 1,854,277 A | | 4/1932 | Schatz | |
| 2,535,501 A | | 12/1950 | Loughridge | |
| 2,785,286 A | | 3/1957 | Lichtgarn | |
| 3,006,443 A | | 10/1961 | Siler | |
| 4,413,719 A | * | 11/1983 | White | B66B 23/14 198/333 |
| 4,842,122 A | * | 6/1989 | Van Nort | B66B 21/04 198/335 |
| 4,953,685 A | | 9/1990 | Johnson | |
| 5,186,302 A | | 2/1993 | Johnson et al. | |
| 5,215,177 A | | 6/1993 | Johnson et al. | |
| 5,307,919 A | * | 5/1994 | Wente | B66B 23/22 198/335 |
| 5,458,220 A | | 10/1995 | Nguyen et al. | |
| 5,542,522 A | | 8/1996 | Adrian et al. | |
| 7,037,027 B2 | | 5/2006 | Steinbeck | |
| 7,300,237 B2 | | 11/2007 | Illedits et al. | |
| 7,407,049 B2 | | 8/2008 | Aulanko et al. | |
| 8,596,445 B2 | | 12/2013 | Ye et al. | |
| 8,757,350 B2 | * | 6/2014 | Ye et al. | B66B 29/02 198/321 |

FOREIGN PATENT DOCUMENTS

| | | | |
|---|---|---|---|
| CN | 104831817 | A | 8/2015 |
| CN | 106629366 | A | 5/2017 |
| DE | 10060963 | A1 | 6/2002 |
| EP | 0622325 | B1 | 7/1997 |
| EP | 0608125 | B1 | 12/1997 |
| EP | 1225151 | A2 | 7/2002 |
| JP | 11-343091 | | 12/1999 |
| JP | 2007112530 | A | 5/2007 |
| JP | 2016069102 | A | 5/2016 |

* cited by examiner

*Primary Examiner* — James R Bidwell
(74) *Attorney, Agent, or Firm* — Carlson, Gaskey & Olds

(57) ABSTRACT

An illustrative example passenger conveyor skirt panel mounting assembly includes a first bracket that is configured to be secured to a truss. A second bracket is configured to support a skirt panel. The second bracket is selectively secured in place relative to the first bracket in a second bracket position that establishes a skirt panel position. An eccentric adjustment member is eccentrically moveable to cause an adjustment of the second bracket position.

20 Claims, 6 Drawing Sheets

PASSENGER CONVEYOR SKIRT PANEL POSITIONING ASSEMBLY

BACKGROUND

Passenger conveyors, such as moving walkways or escalators, include a set of moving steps that carry individuals between landings at opposite ends of the conveyor. Skirt panels are situated next to the steps. It is important to have proper skirt panel position to avoid contact between the skirt panels and the moving steps on one hand and to avoid having too large of a gap between them on the other hand. The task of situating skirt panels tends to be tedious and time consuming. The labor-intensive task adds cost to installation and maintenance procedures.

SUMMARY

An illustrative example passenger conveyor skirt panel mounting assembly includes a first bracket that is configured to be secured to a truss. A second bracket is configured to support a skirt panel. The second bracket is selectively secured in place relative to the first bracket in a second bracket position that establishes a skirt panel position. An eccentric adjustment member is eccentrically moveable to cause an adjustment of the second bracket position.

In a further non-limiting embodiment of the above example assembly, the eccentric adjustment member comprises a plate that is configured to rotate about an axis that is offset from a center of the plate.

In a further non-limiting embodiment of either of the above example assemblies, the plate comprises a circular outer edge.

In a further non-limiting embodiment of any of the above example assemblies, the eccentric adjustment member comprises a shaft extending transversely to the plate. The shaft is engaged with the second bracket such that the shaft and the second bracket move together based on rotary movement of the plate about the axis.

In a further non-limiting embodiment of any of the above example assemblies, the first bracket includes at least one camming surface against which the outer edge of the plate reacts as the plate rotates about the axis.

In a further non-limiting embodiment of any of the above example assemblies, the eccentric adjustment member comprises an eccentric washer including an opening through the washer that is aligned with the axis and the shaft is at least partially received through the opening.

In a further non-limiting embodiment of any of the above example assemblies, the shaft comprises a bolt and the second bracket includes a threaded opening engaged with the bolt.

In a further non-limiting embodiment of any of the above example assemblies, the shaft is at least partially threaded and the second bracket includes a threaded opening engaged with the bolt.

In a further non-limiting embodiment of any of the above example assemblies, the first bracket includes at least one camming surface. The plate has an outer surface that reacts against the camming surface as the plate rotates about the axis.

In a further non-limiting embodiment of any of the above example assemblies, the first bracket includes two camming surfaces. The plate is situated between the two camming surfaces. The plate reacts against both of the two camming surfaces as the plate rotates about the axis.

In a further non-limiting embodiment of any of the above example assemblies, the first bracket comprises a mounting plate and at least one support plate extends transversely from the mounting plate. The second bracket comprises a mounting plate and at least one support plate extending transversely from the mounting plate. The support plate of the second bracket is received against the support plate of the first bracket. The support plate of the first bracket includes a slot. The support plate of the second bracket includes an opening. The eccentric adjustment member comprises a rotatable plate that is rotatable about an axis that is offset from a center of the rotatable plate. The eccentric adjustment member includes a shaft that is transverse to the rotatable plate. The shaft is aligned with the axis. The shaft is at least partially received in the slot. The shaft moves along the shaft based on rotary movement of the rotatable plate. The shaft engages the opening of the support plate of the second bracket such that the shaft and the support plate of the second bracket move together based on rotary movement of the rotatable shaft.

In a further non-limiting embodiment of any of the above example assemblies, the mounting plate of the first bracket comprises a first edge and a second edge that is transverse to the first edge. The at least one support plate of the first bracket comprises a first support plate and a second support plate. The first and second support plates of the first bracket are offset from each other. A distance between the first support plate and the first edge of the first bracket is different than a distance between the second support plate and the first edge of the first bracket. A distance between the first support plate and the second edge of the first bracket is different than a distance between the second support plate and the second edge of the first bracket. The mounting plate of the second bracket comprises a first edge and a second edge that is transverse to the first edge. The at least one support plate of the second bracket comprises a first support plate and a second support plate. The first and second support plates of the second bracket are offset from each other. A distance between the first support plate and the first edge of the second bracket is different than a distance between the second support plate and the first edge of the second bracket. A distance between the first support plate and the second edge of the second bracket is different than a distance between the second support plate and the second edge of the second bracket. The first support plate of the second bracket is received against the first support plate of the first bracket. The second support plate of the second bracket is received against the second support plate of the first bracket.

In a further non-limiting embodiment of any of the above example assemblies, rotary movement of the rotatable plate changes a spacing between the mounting plate of the first bracket and the mounting plate of the second bracket.

In a further non-limiting embodiment of any of the above example assemblies, the opening of the support plate of the second bracket is threaded. The shaft is at least partially threaded. The shaft is threaded into engagement with the opening of the support plate of the second bracket.

In a further non-limiting embodiment of any of the above example assemblies, the rotatable plate comprises an eccentric washer including an opening through the washer aligned with the axis. The shaft comprises a bolt and the bolt is at least partially received through the opening through the washer.

In a further non-limiting embodiment of any of the above example assemblies, the eccentric adjustment member comprises a plate that is configured to rotate about an axis that is offset from a center of the plate. Rotary movement of the plate about the axis causes relative linear movement between the first and second brackets and the relative linear movement is along a direction that is transverse to the axis.

An illustrative example passenger conveyor includes, among other things, the assembly of any of the above example assemblies, a plurality of step surfaces and at least one skirt panel supported in a desired position relative to the step surfaces by any one of the above example assemblies.

A method of adjusting a position of a skirt panel of a passenger conveyor, according to another exemplary aspect of the present disclosure includes, among other things, rotating an eccentric adjustment member to cause linear movement of the skirt panel relative to at least one of a truss or a step surface of the passenger conveyor.

In a further non-limiting embodiment of the example method, the eccentric adjustment member comprises a plate rotatable about an axis that is offset from a center of the plate and the linear movement of the skirt panel is along a direction that is transverse to the axis.

In a further non-limiting embodiment of either of the example methods, a first bracket is secured to the truss. The skirt panel is supported on a second bracket. Rotating the eccentric adjustment member causes relative linear movement between the first and second brackets.

Various features and advantages of at least one disclosed example embodiment will become apparent to those skilled in the art from the following detailed description. The drawings that accompany the detailed description can be briefly described as follows.

DETAILED DESCRIPTION

Embodiments of this invention facilitate quicker and easier skirt panel installation and adjustment. An eccentric adjustment member, including an eccentric washer for example, facilitates positioning a skirt panel relative to the steps of a passenger conveyor in an efficient manner.

Figure 1:
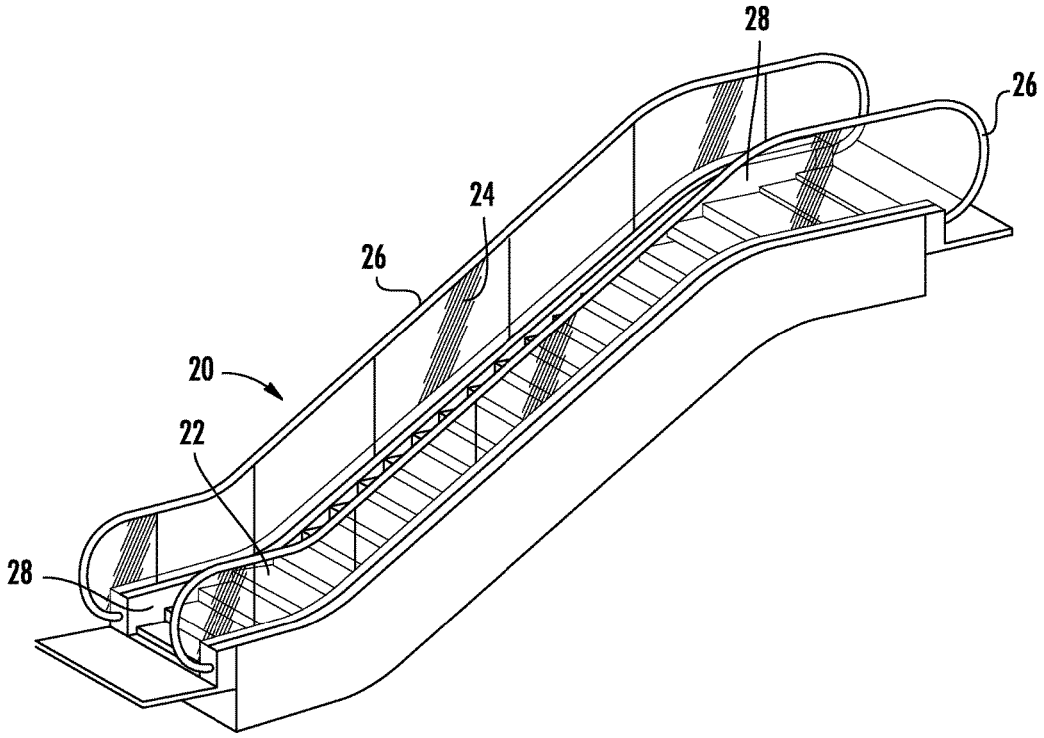
FIG. 1 diagrammatically illustrates a passenger conveyor.

FIG. 1 diagrammatically illustrates a passenger conveyor 20. In this example, the passenger conveyor 20 is an escalator. In other embodiments, the passenger conveyor is a moving walkway. The passenger conveyor 20 includes a plurality of steps 22, balustrades 24 and handrails 26 on opposite sides of the steps 22. Skirt panels 28 are situated next to the steps 22 on opposite sides of the steps 22.

Figure 2:
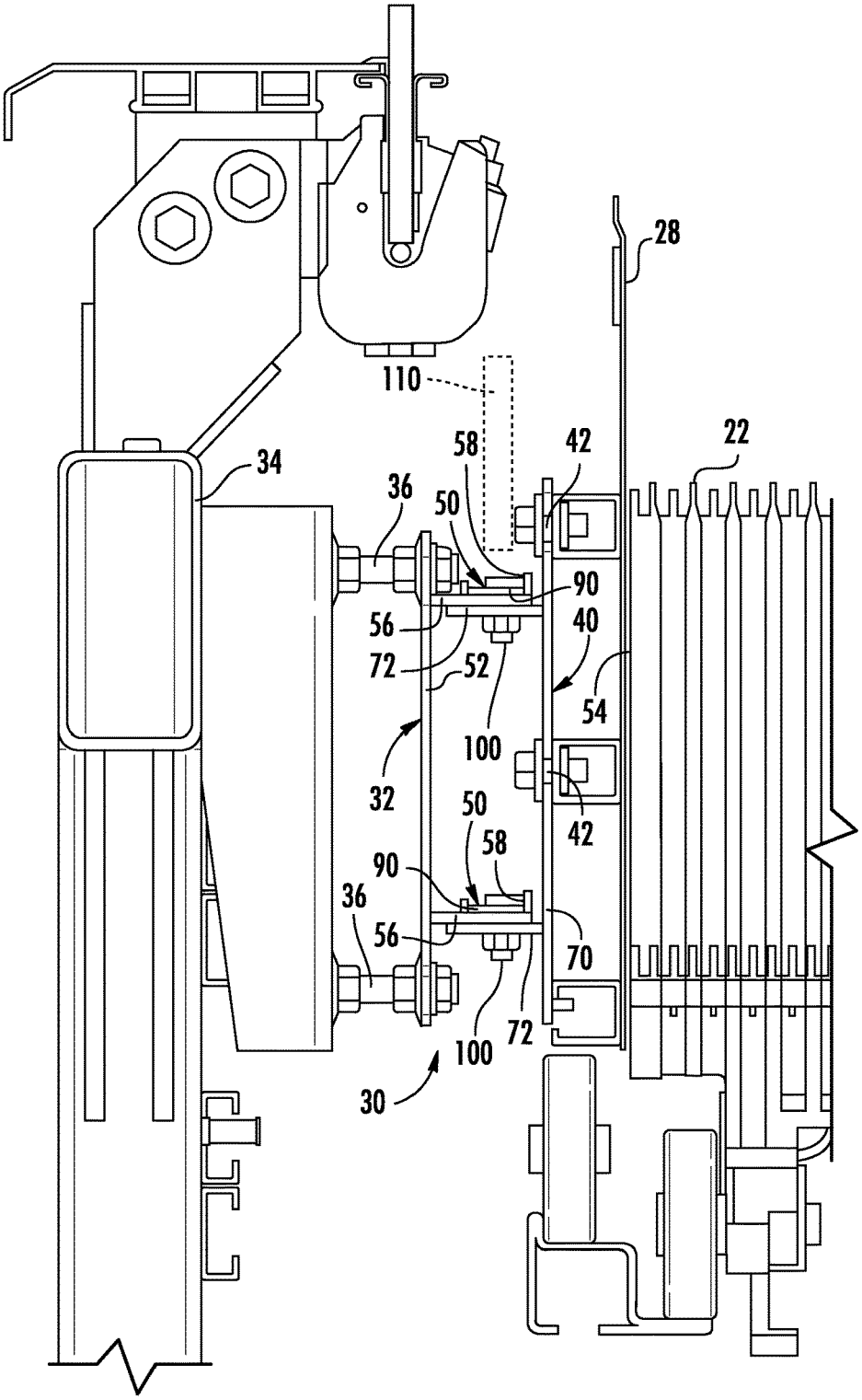
FIG. 2 diagrammatically illustrates selected components of a passenger conveyor including a skirt panel mounting assembly designed according to an embodiment of this invention.

FIG. 2 illustrates selected components of the conveyor 20 including a mounting assembly 30 for mounting the skirt panel 28 in a desired position relative to the steps 22. The mounting assembly 30 includes a first bracket 32 that is configured to be secured to a portion of the passenger conveyor truss 34. In this example, a plurality of fasteners, such as nuts and bolts 36, secure the first bracket 32 to the truss 34. The assembly 30 includes a second bracket 40 that is configured to support the skirt panel 28. In the illustrated example a plurality of fasteners 42 connect the second bracket 40 and the skirt panel 28. The fasteners 42 may be nuts and bolts, for example.

The second bracket 40 is configured to be selectively secured in place relative to the first bracket 32 in a position of the second bracket 40 that establishes a desired position of the skirt panel 28 relative to the steps 22. The assembly 30 includes an eccentric adjustment member 50 that is eccentrically moveable to adjust the relative positions of the first bracket 32 and the second bracket 40.

Referring to FIGS. 2-5, the first bracket 32 includes a mounting plate 52 that is situated generally parallel to a side edge 54 of the steps 22 in an installed position. The first bracket 32 includes first and second support plates 56 that extend transversely from the mounting plate 52. In this example, the support plates 56 are perpendicular to the mounting plate 52. The support plates 56 include at least one camming surface 58. In the arrangement shown in FIGS. 3 and 4, the mounting plate 52 acts as a camming surface facing opposite the camming surfaces 58.

Figure 5:
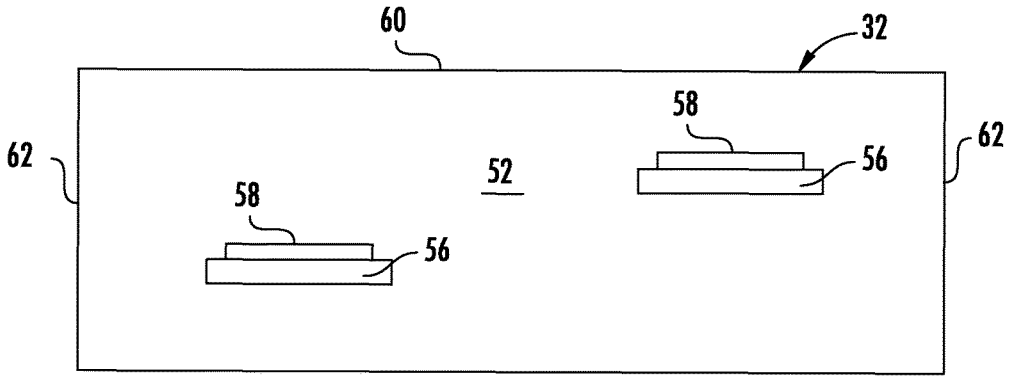
FIG. 5 is a side elevational view of the mounting bracket shown in FIG. 4.
Figure 6:
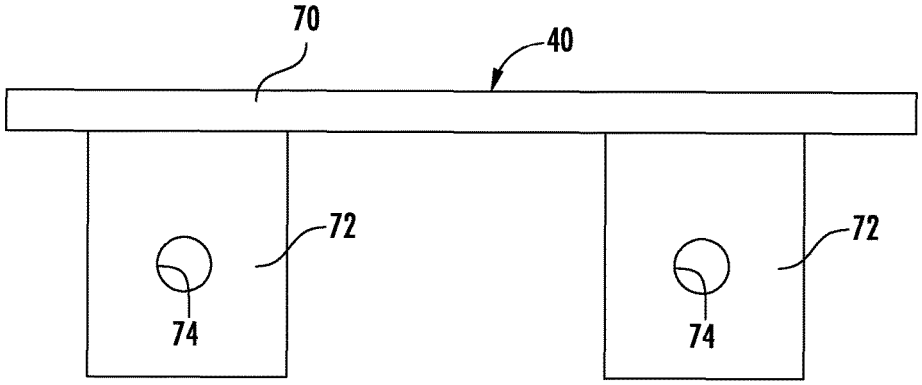
FIG. 6 is a top elevational view of another mounting bracket configuration designed according to an embodiment of this invention.

As best appreciated from FIG. 5, the mounting plate 52 has a first, top edge 60 that is transverse to a second, side edge 62. A first one of the support plates 56 is closer to the first edge 60 than a second one of the support plates 56. The support plates 56 are also differently spaced from the side edge 62 of the mounting plate 52. In other words, the support plates 56 are offset relative to each other. In this example, the support plates 56 are offset relative to each other in a vertical and horizontal orientation when the first bracket 32 is installed as part of the passenger conveyor 20.

Figure 4:
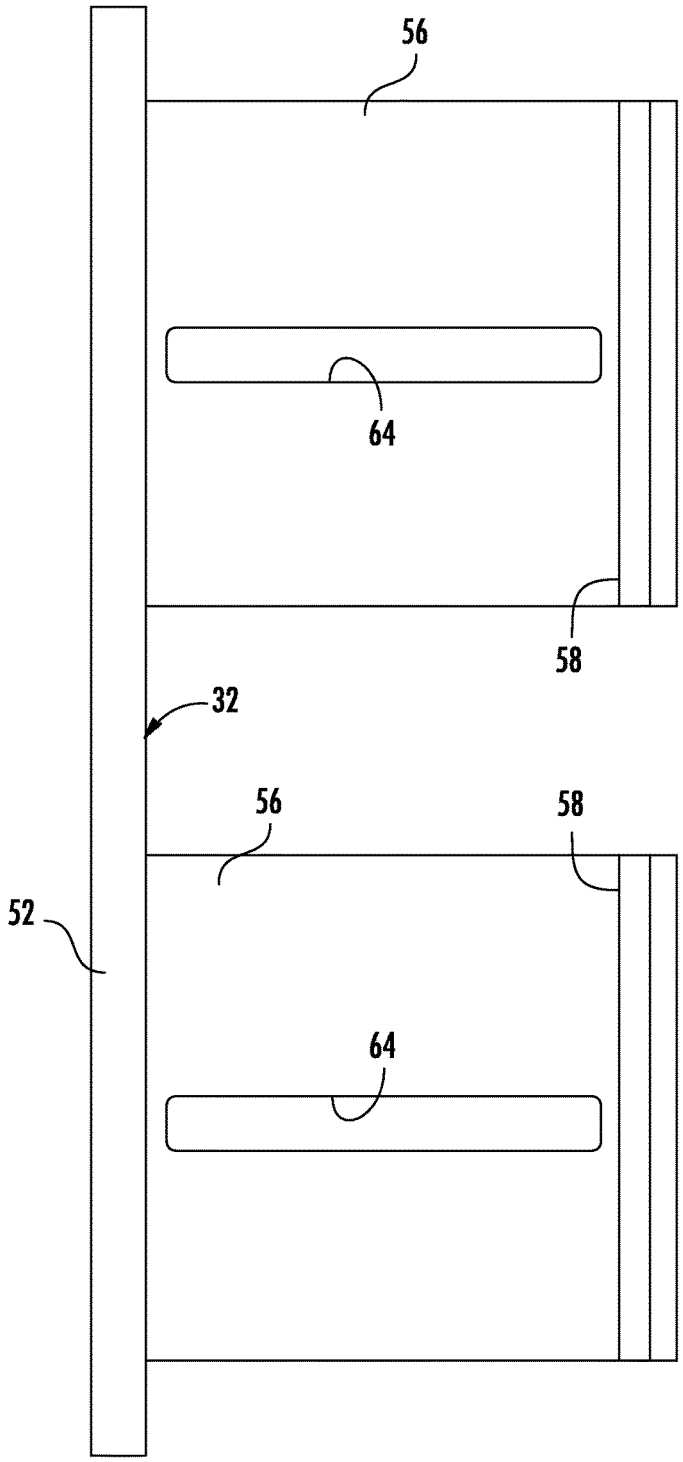
FIG. 4 is a top elevational view of a mounting bracket configuration designed according to an embodiment of this invention.

As shown in FIG. 4, the support plates 56 each include a slot 64 through the support plate. The slots 64 are situated perpendicular to the mounting plate 52 in this example.

Figure 7:
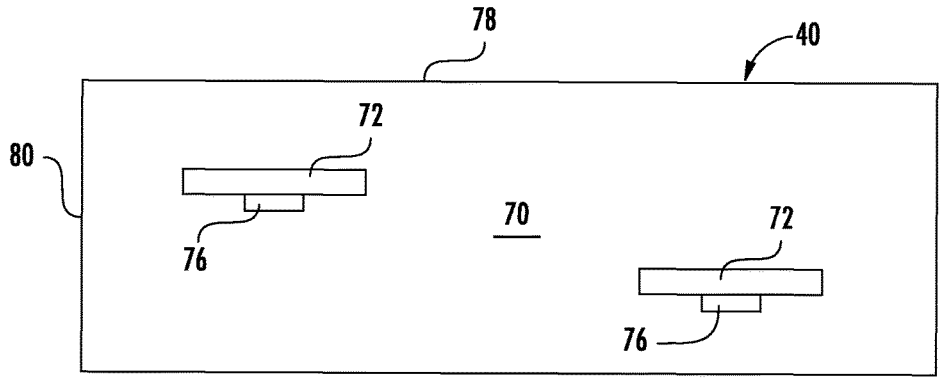
FIG. 7 is a side elevational view of the mounting bracket shown in FIG. 6.

As can be appreciated from FIGS. 2, 3, 6 and 7, the second bracket 40 includes a mounting plate 70 and two support plates 72 that extend transversely from the mounting plate 70. In this example, the support plates 72 are perpendicular to the mounting plate 70. The support plates 72 each include an opening 74 through the plate. In the illustrated example, the opening 74 is at least partially threaded. In this embodiment, nuts 76 are secured to one side of the support plates 72 to provide threads along at least a portion of the opening 74. In some examples, the nuts 76 are welded in place against the underside of the support plates 72 as shown in FIG. 7. In other embodiments, the holes 74 are tapped to include internally facing threads and no nut is required.

As can be appreciated from FIG. 7, the support plates 72 are offset relative to each other. A first one of the support plates 72 is closer to a first edge 78 of the mounting plate 70 compared to a second one of the support plates 72. The first one of the support plates 72 is also closer to a side edge 80 of the mounting plate 70 than the second one of the support plates 72.

Figure 3:
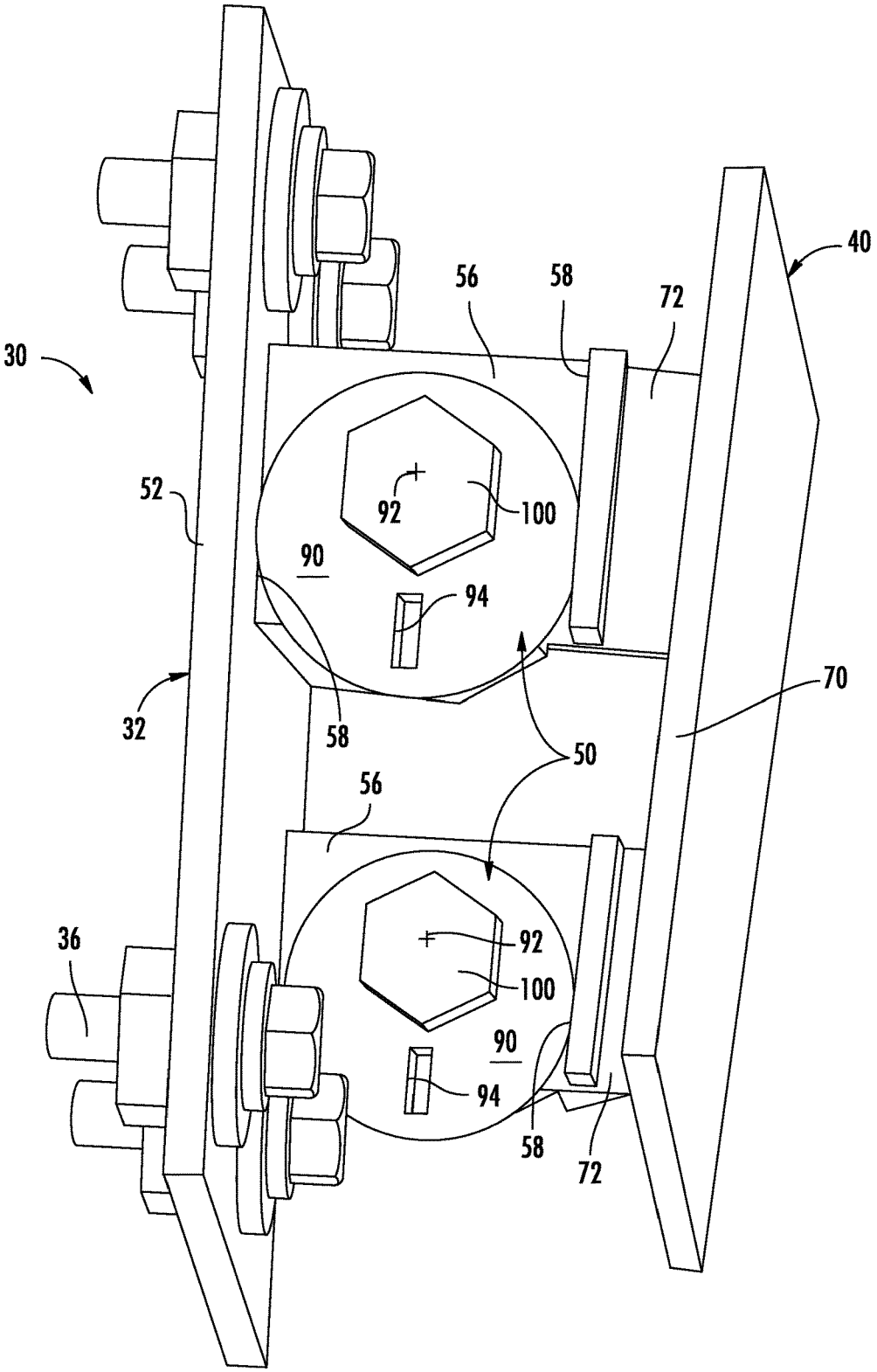
FIG. 3 is a perspective illustration of the example skirt panel mounting assembly.
Figure 8:
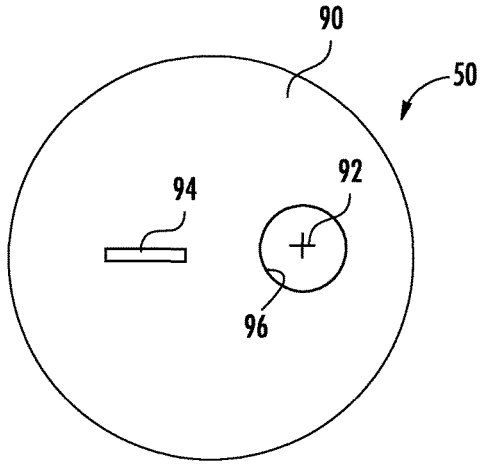
FIG. 8 schematically illustrates an eccentric adjustment member designed according to an embodiment of this invention and useful with the illustrated example embodiment.

As can be seen in FIGS. 2, 3 and 8, the eccentric adjustment member 50 includes a plate 90 that is rotatable about an axis 92 that is offset from a center of the plate 90. In the illustrated example embodiment, the plate 90 has a circular outer edge. The plate 90 includes a slot 94 that may be a recess or groove in one surface of the plate 90.

In the illustrated example, the plate 90 comprises an eccentric washer having an opening 96 through the plate. The opening 96 is aligned with the axis 92.

The adjustment member 50 includes a shaft 100 situated transverse to the plate 90. In the illustrated example, the shaft 100 comprises a bolt that is at least partially received through the opening 96 in the plate 90. In other embodiments, the shaft 100 and plate 90 are integrally formed as a single piece.

As shown in FIGS. 2 and 3, each of the support plates 72 of the second bracket 40 are received against a corresponding one of the support plates 56 of the first bracket 32. Each set of support plates 56, 72 has a corresponding adjustment member 50. The respective plates 90 are received against the support plates 56 of the first bracket 32 so that the outside edges of the plates 90 may react against the camming surfaces 58. The shafts 100 are respectively received through the openings 96 in the plates 90, the slots 64 in the support plates 56, and the openings 74 in the support plates 72. In the illustrated example, the shafts 100, which comprise bolts, are threaded into engagement with the nuts 76 on the underside (according to the drawings) of the support plates 72.

With the shafts or bolts 100 at least slightly loose there is enough play between the plates 90 and the support plates 56 to allow an individual to rotate at least one of the plates 90 about its corresponding axis 92 by inserting a tool schematically shown at 110 in FIG. 2, such as a screwdriver, into the corresponding slot 94. Such rotary motion of the plate 90 is eccentric movement about the axis 92. As the outside edge of the plate 90 reacts against the camming surface 58, that causes linear or translational movement of the shaft 100 along the slot 64. The connection between the shaft 100 and the support plate 72 of the second bracket 40 causes relative movement between the first bracket 32 and the second bracket 40. Eccentric movement of the adjustment member 50 changes the spacing or distance between the mounting plate 52 of the first bracket 32 and the mounting plate 70 of the second bracket 40. Given the way in which the first bracket 32 is connected with the truss 34 and the way in which the second bracket 40 is connected with the skirt panel 28, the eccentric movement of the eccentric adjustment member 50 alters the position of the skirt panel 28 relative to the truss 34 and the steps 32. Once a desired position of the skirt panel 28 based on the position of the second bracket 40 relative to the first bracket 32 has been established, an individual may use a tool, such as a socket wrench (which also may be represented by the structure 110 shown in FIG. 2), to tighten the bolt 100 to secure the second bracket 40 in the desired position corresponding to the desired skirt panel position.

The offset arrangement of the support plates and the orientation of the eccentric adjustment members 50 allow an individual to approach the assembly 30 from above and to customize the position and orientation of the skirt panel 28 to achieve a desired alignment of the skirt panel 28 and the steps 22 in a relatively straightforward and efficient manner.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

I claim:

1. A passenger conveyor skirt panel mounting assembly, comprising:

a first bracket that is configured to be secured to a truss;

a second bracket that is configured to support a skirt panel, the second bracket is configured to be selectively secured in place relative to the first bracket in a second bracket position that establishes a skirt panel position; and an eccentric adjustment member that is eccentrically moveable to cause an adjustment of the second bracket position.

2. The assembly of claim 1, wherein the eccentric adjustment member comprises a plate that is configured to rotate about an axis that is offset from a center of the plate.

3. The assembly of claim 2, wherein the plate comprises a circular outer edge.

4. The assembly of claim 2, wherein the eccentric adjustment member comprises a shaft extending transversely to the plate;

the shaft is engaged with the second bracket such that the shaft and the second bracket move together based on rotary movement of the plate about the axis.

5. The assembly of claim 4, wherein the first bracket includes at least one camming surface against which the outer edge of the plate reacts as the plate rotates about the axis.

6. The assembly of claim 4, wherein the eccentric member adjustment comprises an eccentric washer including an opening through the washer;

the opening through the washer is aligned with the axis; and the shaft is at least partially received through the opening.

7. The assembly of claim 6, wherein the shaft comprises a bolt; and the second bracket includes a threaded opening engaged with the bolt.

8. The assembly of claim 4, wherein the shaft is at least partially threaded; and the second bracket includes a threaded opening engaged with the shaft.

9. The assembly of claim 2, wherein the first bracket includes at least one camming surface;

the plate has an outer surface that reacts against the camming surface as the plate rotates about the axis.

10. The assembly of claim 9, wherein the first bracket includes two camming surfaces;

the plate is situated between the two camming surfaces; and the plate reacts against both of the two camming surfaces as the plate rotates about the axis.

11. The assembly of claim 1, wherein the first bracket comprises a mounting plate and at least one support plate extending transversely from the mounting plate;

the second bracket comprises a mounting plate and at least one support plate extending transversely from the mounting plate;

the support plate of the second bracket is received against the support plate of the first bracket;

the support plate of the first bracket includes a slot;

the support plate of the second bracket includes an opening;

the eccentric adjustment member comprises a rotatable plate that is rotatable about an axis that is offset from a center of the rotatable plate;

the eccentric adjustment member includes a shaft that is transverse to the rotatable plate;

the shaft is aligned with the axis;

the shaft is at least partially received in the slot;

the shaft moves along the slot based on rotary movement of the rotatable plate; and the shaft engages the opening of the support plate of the second bracket such that the shaft and the support plate of the second bracket move together based on rotary movement of the rotatable plate.

12. The assembly of claim 11, wherein the mounting plate of the first bracket comprises a first edge and a second edge that is transverse to the first edge;

the at least one support plate of the first bracket comprises a first support plate and a second support plate;

the first and second support plates of the first bracket are offset from each other;

a distance between the first support plate and the first edge of the first bracket is different than a distance between the second support plate and the first edge of the first bracket;

a distance between the first support plate and the second edge of the first bracket is different than a distance between the second support plate and the second edge of the first bracket;

the mounting plate of the second bracket comprises a first edge and a second edge that is transverse to the first edge;

the at least one support plate of the second bracket comprises a first support plate and a second support plate;

the first and second support plates of the second bracket are offset from each other;

a distance between the first support plate of the second bracket and the first edge of the second bracket is different than a distance between the second support plate of the second bracket and the first edge of the second bracket;

a distance between the first support plate of the second bracket and the second edge of the second bracket is different than a distance between the second support plate of the second bracket and the second edge of the second bracket;

the first support plate of the second bracket is received against the first support plate of the first bracket; and the second support plate of the second bracket is received against the second support plate of the first bracket.

13. The assembly of claim 12, wherein rotary movement of the rotatable plate changes a spacing between the mounting plate of the first bracket and the mounting plate of the second bracket.

14. The assembly of claim 11, wherein the opening of the support plate of the second bracket is threaded;

the shaft is at least partially threaded; and the shaft is threaded into engagement with the opening of the support plate of the second bracket.

15. The assembly of claim 14, wherein the rotatable plate comprises an eccentric washer including an opening through the washer aligned with the axis;

the shaft comprises a bolt; and the bolt is at least partially received through the opening through the washer.

16. The assembly of claim 1, wherein the eccentric adjustment member comprises a plate that is configured to rotate about an axis that is offset from a center of the plate;

rotary movement of the plate about the axis causes relative linear movement between the first and second brackets; and the relative linear movement is along a direction that is transverse to the axis.

17. A passenger conveyor, comprising:

the assembly of claim 1;

a plurality of step surfaces; and at least one skirt panel supported in a desired position relative to the step surfaces by the assembly of claim 1.

18. A method of adjusting a position of a skirt panel of a passenger conveyor, the method comprising rotating an eccentric adjustment member to cause linear movement of the skirt panel relative to at least one of a truss or a step surface of the passenger conveyor.

19. The method of claim 18, wherein the eccentric adjustment member comprises a plate rotatable about an axis that is offset from a center of the plate; and the linear movement of the skirt panel is along a direction that is transverse to the axis.

20. The method of claim 18, wherein a first bracket is secured to the truss;

the skirt panel is supported on a second bracket; and rotating the eccentric adjustment member causes relative linear movement between the first and second brackets.

* * * * *